US006635992B1

(12) United States Patent
Iguchi et al.

(10) Patent No.: US 6,635,992 B1
(45) Date of Patent: Oct. 21, 2003

(54) BOARD FOR PLASMA DISPLAY WITH RIBS, PLASMA DISPLAY AND PRODUCTION PROCESS THEREFOR

(75) Inventors: Yuichiro Iguchi, Shiga (JP); Yuukichi Deguchi, Shiga (JP); Michio Takagi, Shiga (JP); Takaki Masaki, Shiga (JP); Yuko Mikami, Shiga (JP)

(73) Assignee: Toray Industries, Inc., Tokyo (JP)

( * ) Notice: Subject to any disclaimer, the term of this patent is extended or adjusted under 35 U.S.C. 154(b) by 0 days.

(21) Appl. No.: 09/600,703

(22) PCT Filed: Dec. 1, 1998

(86) PCT No.: PCT/JP98/05411

§ 371 (c)(1),
(2), (4) Date: Jul. 21, 2000

(51) Int. Cl.[7] ..... H01J 17/49

(52) U.S. Cl. ..... 313/582; 313/584; 313/586; 313/609

(58) Field of Search ..... 313/582, 584, 313/585, 586, 587, 485, 493, 609, 610

(56) References Cited

U.S. PATENT DOCUMENTS 5,086,297 A * 2/1992 Miyake et al. ..... 345/65
5,754,003 A * 5/1998 Murai et al. ..... 313/582
5,825,128 A * 10/1998 Betsui et al. ..... 313/582
5,957,743 A * 9/1999 Konishi et al. ..... 445/24
6,236,160 B1 * 5/2001 Komaki et al. ..... 313/586
6,411,032 B1 * 6/2002 Shiiki et al. ..... 313/582
6,518,702 B1 * 2/2003 Mori ..... 313/582

FOREIGN PATENT DOCUMENTS

EP 0 436 416 A1 7/1991
JP 09050768 A * 2/1997

* cited by examiner

*Primary Examiner*—Vip Patel
*Assistant Examiner*—Kevin Quarterman
(74) *Attorney, Agent, or Firm*—Morrison & Foerster LLP

(57) ABSTRACT

A board for a plasma color display, on which striped barrier ribs for partitioning address electrodes and discharge spaces are formed, and on which phosphor layer stripes emitting light of red, green and blue are formed in the grooves between the respectively adjacent barrier ribs, characterized in that the following relation is satisfied $$Pb>Pr$$

where Pr is the distance between respectively adjacent barrier ribs for forming a red light emitting phosphor layer, and Pb is the distance between respectively adjacent barrier ribs for forming a blue light emitting phosphor layer, and that the height differences of the barrier ribs within the board face are within ±0.5~±6 μm in reference to the average height of the barrier ribs, or characterized in that phosphor layer stripes respectively emitting light of the same color are formed in respectively adjacent two or more grooves. The present invention can also provide a plasma display which allows a well-balanced brighter color image to be displayed and allows a beautiful white image to be displayed in the case of full face light emission. The present invention can also provide a process for producing the same.

4 Claims, No Drawings

BOARD FOR PLASMA DISPLAY WITH RIBS, PLASMA DISPLAY AND PRODUCTION PROCESS THEREFOR

TECHNICAL FIELD

The present invention relates to a board for a plasma display used in a large television set or computer monitor, a plasma display, and a production process thereof.

BACKGROUND ART

Since plasma displays (PDPs) allow high speed displaying and can be enlarged compared to liquid crystal panels, they are widely in such areas as OA apparatuses and information displays. As they are increasingly used in more areas, color PDPs having many fine display cells attract special attention.

In a PDP, plasma discharges are caused between anodes and cathodes located to face each other in discharge spaces formed between a front glass board and a rear glass board, to let the gas hermetically contained in the spaces emit light, for displaying.

A PDP is formed by bonding together a front glass board and a rear glass board respectively having electrodes, dielectric layer, etc. The rear glass board usually has a plurality of striped barrier ribs formed, and in the cells formed between the respectively adjacent barrier ribs, phosphor layer stripes are formed for color displaying in red, green and blue. These phosphor layer stripes are formed by coating the respective cells with an R (red) light emitting phosphor, G (green) light emitting phosphor or B (blue) light emitting phosphor usually by screen printing, and drying and firing the respective phosphors. To achieve a higher luminance, it is also practiced to form the phosphor layer stripes not only on the bottoms but also on the lateral faces of the cells, for forming a phosphorescent face (U.S. Pat. No. 5,674,553).

As described above, the cells for displaying R, G and B are formed between striped barrier ribs, and the barrier ribs are formed at a constant pitch. Therefore, the respective phosphor layer stripes of R, G and B are equally sized.

Presently developed red light emitting phosphors include $Y_2O_3$:Eu, $YVO_4$:Eu, (Y, Gd)$BO_3$:Eu, $Y_2O_3S$:Eu, g-$Zn_3(PO_4)_2$:Mn, (ZnCd)S:Ag+$In_2O_3$, etc.

Green light emitting phosphors include $Zn_2GeO_2$:Mn, $BaAl_{12}O_{19}$:Mn, $Zn_2SiO_4$, $LaPO_4$:Tb, ZnS:Cu, Al, ZnS:Au, Cu, Al, (ZnCd)S:Cu, Al, $Zn_2SiO_4$:Mn, As, $Y_3Al_5O_{12}$:Ce, $CeMgAl_{11}O_{19}$:Tb, $Gd_2O_2S$:Tb, $Y_3Al_5O_{12}$:Tb, ZnO:Zn, etc.

Blue light emitting phosphors include $Sr_5(PO_4)_3Cl$:Eu, $BaMgAl_{14}O_{23}$:Eu, $BaMgAl_{16}O_{27}$:Eu, $BaMg_2Al_{14}O_{24}$:Eu, ZnS:Ag+red pigment, $Y_2SiO_3$:Ce, etc.

As light emission characteristics of these light emitting phosphors, important are the luminance, emitted color and afterglow, but there is few perfect phosphors. Especially the luminances of blue light emitting phosphors are lower than those of red and green light emitting phosphors, and in the case of color display, a well-balanced color image is unlikely to be obtained disadvantageously. At present, a color display is designed in reference to the level of the blue light emitting phosphor.

DISCLOSURE OF THE INVENTION

The present invention provides a board for a plasma display capable of displaying a well-balanced brighter color image, a plasma display and a production process thereof.

In the conventional plasma display, since barrier ribs provided at a constant pitch and having the same width are used, the cells of respective R, G and B colors are equally sized, and for well-balanced color display, the luminance is adjusted in reference to the blue light emitting phosphor with the lowest luminance level. So, the capabilities of red and green light emitting phosphors are not sufficiently manifested. To obtain a brighter screen, efforts are made to produce improved blue light emitting phosphors higher in luminance, but no blue light emitting phosphor having the same luminance level as those of red and green light emitting phosphors has been developed yet.

Furthermore, in the case of full face light emission, the entire screen becomes yellowish since the luminance of blue is low. So, there is a problem that the beautiful white as displayed by a cathode ray tube cannot be reproduced.

The object of the present invention is to improve the brightness of the blue color emitting phosphor on the color screen for manifesting the red and green light emitting phosphors more brightly, thereby making the entire color image brighter and realizing a beautifully white screen.

To achieve the above object, the plasma display of the present invention is constituted as described below.

A glass board for a plasma color display, on which phosphor layer stripes emitting light of respective R, G and B colors are formed, and on which barrier ribs for partitioning the R, G and B phosphor layer stripes are formed, characterized in that the following relation is satisfied $$Pb>Pr$$

where Pr is the distance between the respectively adjacent barrier ribs for forming a red light emitting phosphor layer, and Pb is the distance between the respectively adjacent barrier ribs for forming a blue light emitting phosphor layer, and that the height differences of the barrier ribs within the board face are within ±0.5~±6 μm in reference to the average height of the barrier ribs.

A board for a plasma display, on which striped barrier ribs for partitioning address electrodes and discharge spaces are formed, and on which phosphor layer stripes emitting red light, green light and blue light are formed in the grooves between the respectively adjacent barrier ribs, characterized in that phosphor layer stripes respectively emitting light of the same color are formed in respectively adjacent two or more grooves. The present invention also provides a plasma display using either of the boards as a rear board, and a process for producing either of the boards.

THE BEST EMBODIMENTS OF THE INVENTION

The suitable height of the barrier ribs of the plasma display is 80 μm to 200 μm. The pitch (P) of barrier ribs often used is in a range of 100 μm≦P≦500 μm. In the case of a highly precise plasma display, it is preferable that the pitch (P) of barrier ribs is 100 μm≦P≦250 μm, and that the rib width (L) is 10 μm≦L≦50 μm. Such highly precise barrier ribs can be formed by a sand blasting method or photosensitive paste method, but the latter photosensitive paste method is more preferable.

A material preferably used for forming the barrier ribs is a glass material containing the oxide of silicon and/or boron as an essential ingredient.

The conventional barrier ribs are formed in stripes at a constant pitch, and for color display, the cells formed between the respectively adjacent striped barrier ribs are coated respectively with a phosphor emitting light of each color, R, G or B. That is, pixels, each consisting of three colors of R, G and B, are disposed in stripes at a constant pitch. For example, if the pitch of barrier ribs is 150 μm, the respective light emitting regions of R, G and B are formed in the same size at this pitch.

Presently practically used typical phosphors include KX-504A for emitting red light, P1-G1S for emitting green light and KX-501A (respectively produced by Kasei Optonics K.K.) for emitting blue light. Among these phosphors, the luminance of blue light emitting phosphor KX-501A (chemical composition: $(Ba, Eu)MgAl_{10}O_{17}$) is at the level of ¼ to ½ compared to those of red light emitting phosphor KX-504A (chemical composition: $(Y, Gd, Eu)BO_3$) and green light emitting phosphor P1-G1 S (chemical composition: $(Zn, Mn)_2SiO_4$).

Since the phosphors of respective colors are different in luminance like this, the luminance levels are matched in the cells of the same size as a conventional practice, but in this case, there is a problem that the luminances of red and green cannot be sufficiently utilized.

While the too large difference especially between the red phosphor layer and the blue phosphor layer in luminance is a problem in the conventional board for a plasma display, it was found that if the distance Pb between the respectively adjacent barrier ribs for the cells coated with the blue phosphor layer is made larger than the distance Pr between the respectively adjacent barrier ribs for the cells coated with the red phosphor layer, the luminance level of the whole can be enhanced, to provide a brighter color image. Furthermore, if Pb is made larger than the distance Pg between the respectively adjacent barrier ribs for the cells coated with the green phosphor layer, the luminance level of the whole can be further enhanced.

Moreover, if a relation of $1<pB/Pr\leqq 4$ is satisfied, both the problem that the blue luminance is low and the problem that the red luminance is high, being liable to lower the color temperature can be solved simultaneously. Furthermore, if a relation of $1<Pb/Pg\leqq 2$ is satisfied, the blue luminance can be further enhanced. Moreover, if a relation of $1<Pg/Pr\leqq 2$ is satisfied, the green luminance with a high visibility to eyes can be enhanced, and a plasma display further higher in the luminance felt by eyes can be produced.

It is preferable that the difference between Pb and Pr is 5 μm to 200 μm, since the characteristic of the red phosphor with a high light emission intensity and the characteristic of the blue phosphor with a low light emission intensity can be balanced to allow a plasma display excellent in luminance and color balance to be obtained. A more preferable range is 5 μm to 100 μm. Similarly, it is preferable that the difference between Pb and Pg is 5 μm to 200 μm. A more preferable range is 5 μm to 100 μm. If the difference is too small, a sufficient effect of enhancing the luminance compared to the conventional luminance cannot be obtained. If the difference is too large, the difference among the discharge spaces emitting light of respective colors of R, G and B becomes so large as to make driving difficult. For example, if the proposal of the present invention is applied to a conventional case of forming barrier ribs at an equal pitch of 150 μm, the respective distances can be set as Pb=200 μm and Pr=Pg=125 μm. The difference between the inter-rib distances in this case is 75 μm. Since a higher luminance can be obtained compared to a conventional case of forming phosphor layer stripes at an equal pitch of 150 μm, a drive circuit can be designed to let the other phosphors have higher luminances matched with the level, allowing a plasma display capable of forming a brighter color image to be obtained.

When a plasma display panel is driven by a drive circuit, for displaying, it often occurs that since the volumes of the discharge spaces respectively having a phosphor layer formed to emit light of any color of red, blue or green are different, a sufficient margin cannot be secured for the drive voltage, and therefore that the image is displayed inaccurately.

However, if the height accuracy of barrier ribs is improved, accurate displaying can be ensured. That is, if the height differences of barrier ribs within the board face are in a range of ±0.5 to ±6 μm in reference to the average height of the barrier ribs, accurate displaying can be ensured. If the height differences are ±0.5 μm or less (−0.5 to 0.5 μm), it is difficult to produce the panel, and impurity gas is likely to remain when the panel is hermetically filled with a gas. If the height differences are ±6 μm or more (there are barrier ribs lower than the average height by 6 μm or more or higher than the average height by 6 μm or more), discharges can leak into adjacent cells engaged in displaying as crosstalks, making it difficult to ensure accurate displaying.

Furthermore, the effect of improving the color purity of a plasma display can be obtained also by a board for a plasma display, on which striped barrier ribs for partitioning address electrodes and discharge spaces are formed, and on which phosphor layer stripes emitting red light, green light and blue light are formed in the grooves between the respectively adjacent barrier ribs, characterized in that phosphor layer stripes respectively emitting light of the same color are formed in respectively adjacent two or more grooves.

That is, the area where each phosphor emitting light of blue, red or green is formed can be changed not only by changing the distance between the respectively adjacent barrier ribs, but also by forming the phosphor layer stripes of blue or green in adjacent grooves. In this case, color purity can be improved, and the luminance can be improved due to a larger phosphor forming area.

Especially when blue phosphor layer stripes are formed in adjacent grooves, the area in which the blue phosphor with a low luminance is formed can be increased, and so the color balance can be improved without lowering the luminances of the other phosphors.

The board for a plasma display of the present invention can be produced by forming electrodes made of silver, copper or chromium, barrier ribs on a dielectric layer made of glass, and phosphor layer stripes emitting light of respective colors of R, G and B.

It is preferable that the barrier ribs are formed by using a photosensitive paste containing inorganic particles and an organic ingredient containing a photoreactive compound as essential ingredients since the manufacturing process is simple and since a highly precise pattern can be achieved.

As the inorganic particles, glass or a ceramic material (alumina or cordierite, etc.), etc. is preferable since it is excellent in transparency. Especially glass or a ceramic material containing silicon oxide, boron oxide or aluminum oxide as an essential ingredient is preferable.

The particle size of the inorganic particles is selected, considering the pattern to be prepared, and it is preferable that the volume average particle size (D50) is 1.5 μm or more. More preferable is 2 μm or more in view of patterning. However, if D50 is 10 μm or more, the surface becomes rugged at the time of patterning. So, it is preferable that D50 is 1.5 to 10 μm. A more preferable range is 2 to 8μm. It is especially preferable in view of patterning to use glass particles with a specific surface area of 0.2 to 3 $m^3/g$.

If the inorganic particles are spherical, a pattern with a high aspect ratio can be achieved. To be specific, it is preferable that the sphericity rate is 80 piece % or more. It is more preferable to use particles with an average particle size of 1.5 $\mu$m to 4 $\mu$m, a specific surface area of 0.5 to 1.5 $m^2/g$ and a sphericity rate of 90 piece % or more. The sphericity rate in this case refers to the rate of spherical or oval particles identified by observation with an optical microscope.

Since the barrier ribs are formed as a pattern on a glass board with a low thermosoftening point, it is preferable to use inorganic particles containing 60 wt % or more of glass particles having a thermosoftening point of 350° C. to 600° C. If glass particles or ceramic particles with a thermosoftening point of higher than 600° C. are added, the shrinkage rate at the time of firing can be kept low, but in this case, it is preferable that the amount of the glass or ceramic particles is 40 wt % or less.

If glass particles with a higher light transmittance are used, a more accurate pattern can be obtained. It is preferable that the glass particles with a high light transmittance used in this case are such that the overall light transmittance of a 40 $\mu$m thick glass sheet prepared by melting the glass particles and measured at the wavelength of the irradiating light, particularly at any wavelength of 365 nm, 405 nm, 429 nm, 436 nm and 488 nm is 70% or more. More preferable is 80% or more.

Furthermore, to prevent the glass board from warping at the time of firing, it is preferable to use glass particles with a linear expansion coefficient of 50 to $90\times10^{-7}$. More preferable is 60 to $90\times10^{-7}$.

As for the chemical composition of the glass particles, it is preferable that the silicon oxide content is 3 to 60 wt %. If less than 3 wt %, the denseness, strength and stability of the glass layer decline, and the thermal expansion coefficient deviates from a desirable range, causing the barrier ribs to be unlikely to be matched with the glass board. If the silicon oxide content is 60 wt % or less, the thermosoftening point declines to allow the barrier ribs to be baked to the glass board.

If the boron oxide content is 5 to 50 wt %, electric, mechanical and thermal properties such as electric insulation, strength, thermal expansion coefficient and the denseness of the insulation layer can be improved. If the boron oxide content is more than 50 wt %, the stability of the glass declines.

If glass particles containing 5 to 50 wt % of at least one of bismuth oxide, lead oxide and zinc oxide are used, a glass paste having a temperature characteristic to allow patterning on the glass board can be obtained. Especially when glass particles containing 5 to 50 wt % of bismuth oxide are used, the pot life of the paste is longer advantageously.

As bismuth based glass particles, it is preferable to use a glass powder composed as follows:

| | |
|---|---|
| Bismuth oxide: | 10 to 40 parts by weight |
| Silicon oxide: | 3 to 50 parts by weight |
| Boron oxide: | 10 to 40 parts by weight |
| Barium oxide: | 8 to 20 parts by weight |
| Aluminum oxide: | 10 to 30 parts by weight |

Furthermore, glass particles containing 3 to 20 wt % of at least one of lithium oxide, sodium oxide and potassium oxide can be used, but in this case, if the amount of the oxides of alkali metals such as lithium, sodium and potassium is kept at 20 wt % or less, the stability of the paste can be improved. Preferable is 15 wt % or less.

As specific glass particles in this case, it is preferable to use a glass powder composed as follows:

| | |
|---|---|
| Lithium oxide: | 2 to 15 parts by weight |
| Silicon oxide: | 15 to 50 parts by weight |
| Boron oxide: | 15 to 40 parts by weight |
| Barium oxide: | 2 to 15 parts by weight |
| Aluminum oxide: | 6 to 25 parts by weight |

In the above composition, sodium oxide or potassium oxide can also be used instead of lithium oxide, but in view of stability of the paste, lithium oxide is preferable.

Furthermore, if glass particles containing both a metal oxide such as lead oxide, bismuth oxide or zinc oxide and an alkali metal oxide such as lithium oxide, sodium oxide or potassium oxide are used, the thermosoftening temperature and the linear expansion coefficient can be easily controlled at a lower alkali content.

Moreover, if aluminum oxide, barium oxide, calcium oxide, magnesium oxide, titanium oxide, zinc oxide, zirconium oxide, etc., especially aluminum oxide, barium oxide and zinc oxide are added to the glass particles, processability can be improved, but in view of the control of thermosoftening point, thermal expansion coefficient and refractive index, it is preferable that the content of the oxides is 40 wt % or less. More preferable is 25 wt % or less.

In general, the glass used as an insulating material has a refractive index of about 1.5 to 1.9. If the average refractive index of the organic ingredient is greatly different from the average refractive index of the inorganic particles, the reflection and scattering at the interfaces between the inorganic particles and the photosensitive organic ingredient become large, making it difficult to improve the overall light transmittance and the straight transmittance, and a highly precise pattern with a high aspect ratio cannot be obtained.

Since the refractive indexes of general organic ingredients are 1.45 to 1.7, it is preferable that the average refractive index of the inorganic particles is 1.5 to 1.75 for matching between the inorganic particles and the organic ingredient in refractive index. It is more preferable that the refractive index is 1.5 to 1.65, since the organic ingredient can be selected from a wider range of candidates advantageously.

If glass or a ceramic material containing much boron oxide or silicon oxide is used as the inorganic particles, the refractive index is relatively small. So, if an organic ingredient with a refractive index of 1.5 to 1.6 is used, the matching in refractive index can be achieved more simply.

However, since the glass particles used for patterning the barrier ribs of a plasma display must be fired on a glass board, glass particles containing lead oxide, bismuth oxide and zinc oxide are often used, and the glass containing these metals mostly has a refractive index of 1.65 or more.

So, lead oxide, bismuth oxide and zinc oxide can be contained by 5 to 16 wt %. If glass particles containing 5 to 20 wt % in total of alkali metal oxides such as lithium oxide, sodium oxide and potassium oxide are used, the average refractive index can be easily controlled, and the glass particles can assure a thermosoftening temperature to allow baking on the glass board and can have an average refractive index of 1.5 to 1.65, to easily allow the difference from the organic ingredient in refractive index to be kept small.

The organic ingredient used in the photosensitive paste refers to an organic ingredient in a paste containing a photosensitive organic substance (the portion remaining after excluding the inorganic ingredient from the paste).

It is preferable that the organic ingredient also has a high light transmittance. It is especially preferable that the overall light transmittance of its 40 μm thick film measured at any wavelength of 365 nm, 405 nm, 420 nm, 436 nm and 488 nm is 70% or more.

The organic ingredient contains at least one photosensitive ingredient selected from photosensitive monomers, photosensitive oligomers and photosensitive polymers, and as required, contain such additives as a binder, photo-polymerization initiator, light absorber, sensitizer, sensitizing auxiliary, polymerization inhibitor, plasticizer, thickener, organic solvent, antioxidant, dispersing agent, organic or inorganic precipitation preventive agent and leveling agent.

The photosensitive ingredient can be either of photo-nonsolubilizing type or photo-solubilizing type, and typical photosensitive ingredients include the following (A) to (E).

Photo-nonsolubilizing type photosensitive ingredients include:

(A) Those containing a functional monomer, oligomer or polymer having one or more unsaturated groups, etc. in the molecule, (B) Those containing a photosensitive compound such as an aromatic diazo compound, aromatic azide compound or organic halogen compound, etc.

(C) Diazo resins such as a condensation product between a diazo based amine and formaldehyde.

The photo-solubilizing type photosensitive ingredients include:

(D) Those containing an inorganic salt of a diazo compound, a complex with an organic acid or a quinonediazo.

(E) Those obtained by combining a quinonediazo with a proper polymer binder, such as naphthoquinone-1,2-diazido-5-sulfonate of phenol novolak resin.

As the photosensitive ingredient used in the present invention, any of the above can be used. As a photosensitive ingredient which can be simply mixed with inorganic particles to make the photosensitive paste, any of the those stated in (A) is preferable.

The photosensitive monomers include compounds containing a carbon-carbon unsaturated bond, and they include, for example, monofunctional and polyfunctional (meth) acrylates, vinyl based compounds, and allyl based compounds. One or more of them can be used.

In addition to the above, if an unsaturated acid such as an unsaturated carboxylic acid is added, the developability after sensitizing can be improved. The unsaturated carboxylic acids which can be used here include, for example, acrylic acid, methacrylic acid, itaconic acid, crotonic acid, maleic acid, fumaric acid, vinylacetic acid, and their anhydrides.

Furthermore, an oligomer or polymer obtained by polymerizing at least one of compounds having a carbon-carbon double bond can be used. In polymerization, any of the monomers can be copolymerized with another photosensitive monomer, to keep the former monomer content at 10 wt % or more, preferably 35 wt % or more.

If an unsaturated acid such as an unsaturated carboxylic acid is copolymerized, the developability after sensitizing can be improved. The unsaturated carboxylic acids which can be used here include, for example, acrylic acid, methacrylic acid, itaconic acid, crotonic acid, maleic acid, fumaric acid, vinylacetic acid, and their anhydrides. It is preferable that the polymer or oligomer having acid groups such as carboxyl groups at the side chains obtained like this has an acid value (AV) of 50 to 180. A more preferable range is 70 to 140.

If photoreactive groups are added at the side chains or molecular ends of the above polymer or oligomer, it can be used as a photosensitive polymer or photosensitive oligomer. Preferable photosensitive groups are those having ethylenic unsaturated groups. The ethylenic unsaturated groups include, for example, vinyl groups, allyl groups, acrylic groups, and methacrylic groups.

The addition of such side chains to the oligomer or polymer can be effected by letting an ethylenic unsaturated compound having a glycidyl group or isocyanate group, acrylic acid chloride, methacrylic acid chloride or allyl chloride react with the mercapto groups, amino groups, hydroxyl groups or carboxyl groups in the polymer.

The ethylenic unsaturated compounds having a glycidyl group which can be used here include, for example, glycidyl acrylate, glycidyl methacrylate, allyl glycidyl ether, glycidyl ethylacrylate, crotonyl glycidyl ether, glycidyl crotonate ether, and glycidyl isocrotonate ether.

The ethylenic unsaturated compounds having an isocyanate group which can be used here include, for example, (meth)acryloyl isocyanate, and (meth)acryloylethyl isocyanate. Furthermore, it is preferable that the ethylenic unsaturated compound having a glycidyl group or isocyanate group, acrylic acid chloride, methacrylic acid chloride or allyl chloride is added by 0.05 to 1 mole for each mole of the mercapto groups, amino groups, hydroxyl groups or carboxyl groups in the polymer.

The binders which can be used here include, for example, polyvinyl alcohol, polyvinyl butyral, methacrylate polymers, acrylate polymers, acrylate-methacrylate copolymers, a-methylstyrene polymer, and butyl methacrylate resin.

The photo-polymerization initiators which can be used here include, for example, benzophenone, methyl O-benzoylbenzoate, 4,4-bis(dimethylamino)benzophenone, 4,4-bis(diethylamino)benzophenone, 4,4-dichlorobenzophenone, 4-benzoyl-4-methyl phenyl ketone, dibenzyl ketone, fluorenone, 2,3-diethoxyacetophenone, 2,2-dimethoxy-2-phenyl-2-phenylacetophenone, 2-hydroxy-2-methylpropiophenone, p-t-butyldichloroacetophenone, thioxanthone, 2-methylthioxanthone, 2-chlorothioxanthone, 2-isopropylthioxanthone, diethylthioxanthone, benzyl, benzyl methyl ketal, benzyl methoxyethyl acetal, benzoin, benzoin methyl ether, benzoin butyl ether, anthrquinone, 2-t-butylanthraquinone, 2-aminoanthraquinone, b-chloroanthraquinone, anthrone, benzanthrone, dibenzsuberone, methyleneanthrone, 4-azidobenzalacetophenone, 2,6-bis(p-azidobenzylidene) cyclohexane, 2,6-bis(p-azidobenzylidene)-4-methylcyclohexanone, 2-phenyl-1,2-butadione-2-(o-methoxycarbonyl)oxime, 1-phenylpropanedione-2-(o-ethoxycarbonyl)oxime, 1,3-diphenylpropanetrione-2-(o-ethoxycarbonyl)oxime, 2-methyl-[4-(methylthio)phenyl]-2-morpholino-1-propanone, naphthalenesulfonyl chloride, quinolinesulfonyl chloride, N-phenylthioacridone, 4,4-azobisisobutyronitrile, diphenyl disulfide, benzthiazole disulfide, triphenylphosphine, camphorquinone, carbon tetrabromide, tribromophenylsulfone, benzoyl peroxide, and combinations between a photoreducing coloring matter such as Eosine or Methylene Blue and a reducing agent such as ascorbic acid or triethanolamine.

In the present invention, one or more of these photo-polymerization initiators can be used. It is preferable that the photo-polymerization initiator is added by 0.05 to 10 wt % based on the weight of the photosensitive ingredient. A more preferable range is 0.1 to 5 wt %. If the amount of the photo-polymerization initiator is too small, photosensitivity becomes poor, and if the amount of the photo-polymerization initiator is too large, the remaining rate of the exposed portions may become too small.

It is also effective to add a light absorber. If a compound with a high effect of absorbing ultraviolet light or visible light is added, a high aspect ratio, high precision and high resolution can be obtained.

As the light absorber, an organic dye can be preferably used. The organic dyes which can be used here include, for example, azo based dyes, aminoketone based dyes, xanthene based dyes, quinoline based dyes, anthraquinone based dyes, benzophenone based dyes, diphenyl cyanoacrylate based dyes, triazine based dyes, and p-aminobenzoic acid based dyes. Even if an organic dye is used as a light absorber, it does not remain in the insulation film after firing, and the decline of the insulation film properties by the light absorber can be kept small preferably. Among the organic dyes, azo based dyes and benzophenone based dyes are preferable.

It is preferable that the amount of the organic dye added is 0.05 to 5 wt %. If the amount is less than 0.05 wt %, the effect of adding the light absorber decreases, and if more than 5 wt %, the insulation film properties after firing decline unpreferably. A more preferable range is 0.05 to 1 wt %.

An organic dye as a light absorber can be added, for example, by preparing a solution with an organic dye dissolved in an organic solvent, and kneading it when the paste is prepared, or by mixing inorganic particles in an organic solvent, and drying the mixture. Thus, a capsulated powder in which each of inorganic particles is coated with an organic film on the surface can be produced.

The sensitizer is added for improving the sensitivity. The sensitizers which can be used here include, for example, 2,4-diethylthioxanthone, isopropylthioxanthone, 2,3-bis(4-diethylaminobenzal)cyclopentanone, 2,6-bis(4-dimethylaminobenzal)cyclohexanone, 2,6-bis(4-dimethylaminobenzal)-4-methylcyclohexanone, Michler's ketone, 4,4-bis(diethylamino)benzophenone, 4,4-bis(dimethylamino)chalcone, 4,4-bis(diethylamino)chalcone, p-dimethylaminocinnamilideneindanone, p-dimethylaminobenzylideneindanone, 2-(p-dimethylaminophenylvinylene)isonaphthothiazole, 1,3-bis(4-dimethylaminophenylvinylene)isonaphthothiazole, 1,3-bis(4-dimethylaminobenzal)acetone, 1,3-carbonylbis(4-diethylaminobenzal)acetone, 3,3-carbonylbis(7-diethylaminocumarin), N-phenyl-N-ethylethanolamine, N-phenylethanolamine, N-tolyldiethanolamine, isoamyl dimethylaminobenzoate, isoamyl diethylaminobenzoate, 3-phenyl-5-benzoylthiotetrazole, and 1-phenyl-5-ethoxycarbonylthiotetrazole. One or more of them can be used.

Some of the sensitizers can also be used as photo-polymerization initiators. If a sensitizer is added to the photosensitive paste, it is preferable that the amount of it added is 0.05 to 10 wt %. A more preferable range is 0.1 to 10 wt %. If the amount of the sensitizer is too small, the effect of improving the photo-sensitivity cannot be manifested, and if too large, the remaining rate of the exposed portions may become too small.

An organic solvent may also be added to the photosensitive paste, when it is desired to adjust the viscosity of its solution. The organic solvents which can be used here include methyl cellosolve, ethyl cellosolve, butyl cellosolve, methyl ethyl ketone, dioxane, acetone, cyclohexanone, cyclopentanone, isobutyl alcohol, isopropyl alcohol, tetrahydrofuran, dimethyl sulfoxide, g-butyllactone, bromobenzene, chlorobenzene, dibromobenzene, dichlorobenzene, bromobenzoic acid, chlorobenzoic acid, and organic solvent mixtures containing one or more of the foregoing.

The refractive index of the organic ingredient refers to the refractive index of the organic ingredient in the paste at the time when the photosensitive ingredient is sensitized by exposure. That is, if the paste applied is exposed after drying, it refers to the refractive index of the organic ingredient in the paste after drying. For example, after the paste is applied on the glass board, it is dried at 50 to 100° C. for 1 to 30 minutes, and the refractive index can be measured.

It is preferable that the refractive index of the organic ingredient is 1.5 to 1.65. A more preferable range is 1.5 to 1.6. Especially if the average refractive index of glass particles is 1.55 to 1.65 and the average refractive index of the organic ingredient is 1.5 to 1.6, then the glass particles and the organic ingredient can be selected from a wider range of candidates, and the straight transmittance can be easily improved advantageously.

However, a glass powder containing 10 wt % or more of bismuth oxide or lead oxide to allow baking on the glass board may have a refractive index of 1.6 or more, and in this case, the refractive index of the organic ingredient must be kept higher. In this case, it is necessary to introduce a high refractive index ingredient into the organic ingredient, and it is effective to achieve a higher refractive index, to use 10 wt % or more of a compound having a sulfur atom, bromine atom, iodine atom, naphthalene ring, biphenyl ring, anthracene ring or carbazole ring in the organic ingredient. However, since some of these compounds can lower the transmittance due to light absorption, it is preferable that the amount of the high refractive index ingredient is kept at 20 wt % or less. Furthermore, if the organic ingredient contains 20 wt % or more of benzene rings, a higher refractive index can be achieved. Especially if the organic ingredient contains 10 wt % or more of sulfur atoms or naphthalene rings, the organic ingredient can be made higher in refractive index more simply. However, if the content is 60 wt % or more, the photo-sensitivity declines disadvantageously. So, it is preferable that the total content of sulfur atoms and naphthalene rings is 10 to 60 wt %.

The refractive index of the organic ingredient can be effectively enhanced by using a compound having a sulfur atom or naphthalene ring in the photosensitive monomer or binder.

The photosensitive paste is usually produced by mixing respectiveingredients such as inorganic particles, light absorber, photosensitive polymer, photosensitive monomer, photo-polymerization initiator, glass frit and solvent, to achieve a predetermined composition, and homogeneously mixing and dispersing the mixture by a 3-roll mill or kneading machine.

The viscosity of the paste is adequately adjusted by the amounts of, for example, inorganic particles, thickener, organic solvent, plasticizer, and precipitation preventive agent added, and is usually 2,000 to 200,000 cps (centipoises). For example, if the paste is applied to the glass board by spin coating, instead of screen printing, it is preferable that the viscosity is 200 to 5,000 cps. To obtain a 10 to 20 $\mu$m thick film by one time of screen printing, it is preferable that the viscosity is 50,000 to 200,000 cps. If a blade coater or die coater is used for example, it is preferable that the viscosity is 2,000 to 20,000 cps.

The formation of barrier ribs by using a photosensitive paste. is carried out as described below.

A glass board is coated with a photosensitive paste, by a general method such as screen printing or using, for example, a bar coater, roll coater, die coater or blade coater. The coating thickness can be adjusted by selecting the coating times, the mesh size of the screen, and the viscosity of the paste. Especially if the thickness accuracy of coating is kept within ±10 μm of the average thickness, the height uniformity of formed barrier ribs improves.

When a glass board is coated with a paste, the glass board can be treated on the surface beforehand, to enhance the adhesiveness between the glass board and the coating film. The surface treating agents which can be used here include, for example, silane couplings such as vinyltrichlorosilane, vinyltrimethoxysilane, vinyltriethoxysilane, tris(2-methoxyethoxy)vinylsilane, g-glycidoxypropyltrimethoxysilane, g-(methacryloxypropyl)trimethoxysilane, g-(2-aminoethyl) aminopropyltrimethoxysilane, g-chloropropyltrimethoxysilane, g-mercaptopropyltrimethoxysilane and g-aminopropyltriethoxysilane, and organic metals such as organic titanium, organic aluminum and organic zirconium. It is preferable that a silane coupling agent or organic metal is diluted to 0.1 to 5% in concentration by an organic solvent such as ethylene glycol monomethyl ether, ethylene glycol monoethyl ether, methyl alcohol, ethyl alcohol, propyl alcohol orbutyl alcohol. Then, the surface treating solution is uniformly applied onto the glass board by, for example, a spinner, and dried at 80 to 140° C. for 10 to 60 minutes, to complete surface treatment.

The applied photosensitive paste is exposed using an exposing machine. For exposure, it is general to use a photo mask for mask exposure, as practiced with ordinary photolithography. As the mask used, either negative type or positive type is selected, depending on the photosensitive organic ingredient used. Furthermore, without using a photo mask, for example, a laser beam can be used for direct depicting.

The photo mask used for exposure has openings corresponding to the pitch of barrier ribs, and in this case, if the openings of the photo mask are formed in such a manner that the barrier ribs are formed at different intervals suitable for the respective phosphors of R, G and B, the barrier ribs formed by exposure can satisfy the requirement of the present invention.

The exposing machine used can be, for example, a stepper exposing machine or proximity exposing machine. For large-area exposure, an exposing machine having a small exposure area can be moved to expose a large-area photosensitive paste applied on the glass board.

The active light source used in this case can be, for example, visible ray, near ultraviolet ray, ultraviolet ray, electron beam, X-ray or laser beam. Among them, an ultraviolet ray is most preferable, and the light source used can be, for example, a low pressure mercury lamp, high pressure mercury lamp, extra high pressure mercury lamp, halogen lamp or microbicidal lamp. Among them, an extra high pressure mercury lamp is suitable. The exposure conditions depend on the coating thickness. An extra high pressure mercury lamp with an output of 1 to 100 $mW/cm^2$ can be used for exposure for 0.5 to 30 minutes.

If an oxygen intercepting film is formed on the surface of the applied photosensitive paste, the pattern can be improved. The oxygen intercepting film can be, for example, a film of polyvinyl alcohol or cellulose or a film of a polyester.

A polyvinyl alcohol film can be formed, for example, by coating the board with a 0.5 to 5 wt % polyvinyl alcohol aqueous solution uniformly using a spinner, and drying at 70 to 90° C. for 10 to 60 minutes, to evaporate water. In this case, it is preferable that a small amount of an alcohol is added to the aqueous solution, because of higher wettability and easier evaporation. Furthermore, it is preferable that the concentration of the polyvinyl alcohol solution is 1 to 3 wt %. If the concentration is in this range, the sensitivity can be further improved. The reason why the sensitivity is improved by applying polyvinyl alcohol is estimated to be as described below. That is, it is estimated that the oxygen in air disturbs the photoreaction of the photosensitive ingredient, and it is considered that if a polyvinyl alcohol film exists, extra oxygen can be intercepted to improve the sensitivity at the time of exposure. So, the existence of a polyvinyl alcohol film can be said to be preferable.

When a transparent film of, for example, a polyester, polypropylene or polyethylene is used, the film can be stuck onto the applied photosensitive paste.

After completion of exposure, development is effected by using the difference between exposed portions and non-exposed portions in solubility to the developer. In this case, immersion, spraying or brushing is used.

As the developer, an organic solvent which can dissolve the organic ingredient in the photosensitive paste is used. Furthermore, water may also be added to the organic solvent as far as the dissolving power of the organic solvent is not lost. If a compound having an acid group such as a carboxyl group exists in the photosensitive paste, an alkali aqueous solution can be used for development. The alkali aqueous solution used can be an aqueous solution of, for example, sodium hydroxide, sodium carbonate or calcium hydroxide, but it is preferable to use an organic alkali aqueous solution, since the alkali component can be easily removed at the time of firing.

As the organic alkali, a general amine compound can be used. The general amine compounds which can be used here include, for example, tetramethylammonium hydroxide, trimethylbenzylammonium hydroxide, monoethanolamine and diethanolamine. The concentration of the alkali aqueous solution is usually 0.01 to 10 wt %. A more preferable range is 0.1 to 5 wt %. If the alkali concentration is too low, the soluble portions cannot be removed, and if too high, the pattern may be peeled while non-soluble portions may be corroded unpreferably. It is preferable in view of process control that the development temperature is 20 to 50° C.

Subsequently, firing is effected in a firing furnace. The atmosphere and temperature of firing depend on the paste and the board used. An atmosphere of, for example, air, nitrogen or hydrogen is used for firing. The firing furnace used can be a batch type firing furnace or belt type continuous firing furnace. The firing temperature is 400 to 1000° C. For processing the pattern on the glass board, firing is effected at 450 to 620° C. for 10 to 60 minutes.

That is, preferably, the barrier ribs can be obtained by a process comprising the step of fully applying a photosensitive paste, the step of exposing to a barrier rib pattern, the step of developing for removing the portions dissolved by a developer, and the step of firing at 450° C. to 620° C. in this order. After the barrier ribs have been formed, phosphor layer stripes emitting light of respective colors of R, G and B are formed. Phosphor pastes respectively mainly composed of a phosphor powder, organic binder and organic solvent are deposited in the predetermined grooves between the respectively adjacent barrier ribs, to form the phosphor layer stripes. For depositing the respective phosphor pastes at the predetermined grooves between the respectively adjacent barrier ribs, the pattern can be printed by screen printing. As another method, the phosphor pastes can be discharged from a die having discharge holes at predetermined intervals into the predetermined grooves between the respectively adjacent barrier ribs.

Furthermore, photosensitive phosphor pastes can be prepared by using any of said photosensitive organic ingredients as an organic binder, and the phosphor layer stripes of respective colors can be formed at the predetermined positions by photolithography.

If the following relations are satisfied $$10\ \mu m \leqq Tr < Tb \leqq 50\ \mu m$$

$$10\ \mu m \leqq Tg < Tb \leqq 50\ \mu m$$

where Tr is the thickness of the R phosphor layer; Tg is the thickness of the G phosphor layer; and Tb is the thickness of the B phosphor layer, then the effect of the present invention can be manifested more highly. That is, if the blue with a low luminance is deposited not only more widely but also more thickly than the green and red, a plasma display with a more excellent color balance (higher color temperature) can be obtained. If the thickness of each phosphor layer in this case is smaller than 10 $\mu$m, a sufficient luminance is unlikely to be obtained. If larger than 50 $\mu$m, the discharge space becomes narrow, being likely to lower the luminance. The thickness of each phosphor layer in this case refers to the thickness of the phosphor layer formed at an intermediate portion between adjacent barrier ribs, that is, the thickness of the phosphor layer formed in the bottom of each discharge space (cell).

If the board having the phosphor layer stripes formed is fired at 400 to 550° C. as required, the board for a plasma display of the present invention can be obtained.

The board for a plasma display is hermetically bonded to a front board, i.e., a glass board having transparent electrodes, bus electrodes, dielectric and protective film (MgO) formed in a predetermined pattern, and the spaces formed between the barrier ribs of the board are hermetically filled with a discharge gas such as helium, neon or xenon. Then, a drive circuit is installed, to parepare a plasma display.

The present invention is described below more concretely in reference to examples, but is not limited thereto or thereby.

EXAMPLE 1

On a 450 mm×350 mm glass board (2.8 mm thick, PD200 produced by Asahi Glass Co., Ltd.), 1920 address electrodes were formed using a photosensitive silver paste. The electrodes were formed in stripes with pitches of 240, 220 and 200 $\mu$m cyclically repeated, to have a width of 60 $\mu$m respectively. On the electrodes, a glass paste consisting of 50 wt % of a glass powder, 15% of titanium oxide, 20% of ethyl cellulose and 15% of a solvent was applied by screen printing, dried at 100° C. for 20 minutes, and fired at 570° C., to form a dielectric layer.

On the board, black barrier ribs were formed according to a photosensitive paste method as described below. A solvent (g-butyllactone) and a photosensitive polymer were mixed to obtain 40% photosensitive polymer solution, and the solution was heated to 60° C. with stirring, to homogeneously dissolve all the polymer. The photosensitive polymer was a polymer with a weight average molecular weight of 43,000 and an acid value of 95 obtained by adding 0.4 equivalent of glycidyl methacrylate for each equivalent of carboxyl groups of the copolymer consisting of 40% of methacrylic acid, 30% of methyl methacrylate and 30% of styrene, for reaction. The solution was then cooled to room temperature, and a photosensitive monomer, photo-polymerization initiator, sensitizer, etc. were added for dissolution. Then, the solution was fed through a 400-mesh filter, to prepare a photosensitive organic ingredient. The photosensitive monomer, photo-polymerization initiator and sensitizer used in this example were the following compounds.

Photosensitive monomer: A compound with 4 moles of glycidyl methacrylate added to 1 mole of xylylenediamine Photo-polymerization initiator: 2-benzyl-2-dimethylamino-1-(4-morpholinophenyl)-butanone-1

Sensitizer: 2,4-diethylthioxanthone

Then, azo-based organic dye Sudan was weighed by 0.10% based on the amount of the glass powder. The Sudan was dissolved into acetone, and a dispersing agent was added. The mixture was homogeneously stirred by a homogenizer, and a glass powder was added into the solution, to be homogeneously dispersed and mixed. The mixture was dried at 150 to 200° C., to evaporate acetone, using a rotary evaporator. Thus, a powder in which the surfaces of glass particles were homogeneously coated with a film of an organic dye as an ultraviolet ray absorber (capsulated) was prepared.

The glass powder used had a composition of $Li_2O$:9%, $SiO_2$:22%, $B_2O_3$:33%, BaO:4%, $Al_2O_3$:23%, ZnO:2% and MgO:7%. The glass powder was finely ground by an attritor beforehand, to have an average particle size of 2.6 $\mu$m and refractive index of 1.58.

The organic ingredient and the glass powder containing the ultraviolet ray absorber were mixed to achieve a composition consisting of 60 parts by weight of the glass powder, 25 parts by weight of the photosensitive organic ingredient (excluding the solvent) and 15 parts by weight of the solvent (g-butyllactone), and the mixture was mixed and dispersed by a three-roller mill, to prepare a photosensitive paste.

The glass board having the striped address electrodes formed at intervals corresponding to the different distances between the respectively adjacent barrier ribs for forming phosphor layer stripes, and also having the dielectric layer was coated with the photosensitive paste by a slit die coater, to have a thickness of 180 $\mu$m after drying, and dried at 80° C. for 1 hour. In this case, the heights of 36 places within the board face were 180±5 $\mu$m.

Then, it was exposed through a photo mask. The mask was a chromium mask designed to allow a striped barrier rib pattern to be formed in a plasma display, in such a manner that the inter-rib pitch for forming the B phosphor layer might be 240 $\mu$m, that the inter-rib pitch for forming the R phosphor layer might be 200 $\mu$m, that the inter-rib pitch for forming the G phosphor layer might of 220 $\mu$m, and that the rib width might be 30 $\mu$m. For exposure, an extra high pressure mercury lamp with an output of 50 mW/cm$^2$ was used for ultraviolet exposure. Then, the board was immersed in 1% monoethanolamine aqueous solution, for development.

The glass board obtained by patterning the photosensitive paste was dried at 120° C. for 1 hour, and fired at 560° C. for 1 hour. The firing caused shrinking of about 20%. The average height of the obtained barrier ribs was 135 $\mu$m, and the height differences at 36 places within the board face were ±4 $\mu$m in reference to the average height.

The board having electrodes, dielectric and barrier ribs formed was coated with R, G and B phosphors by screen printing, dried and fired, to form phosphor layer stripes. The phosphors were applied not only to the bottoms of the grooves between the respectively adjacent barrier ribs but also on the lateral faces of the barrier ribs, to form a phosphorescent face on the bottoms and lateral faces.

The rear glass board formed like this was joined with a front glass board prepared separately, and hermetically sealed, and the spaces inside were hermetically filled with a gas. A drive circuit was connected to it, to prepare a plasma display, and a voltage was applied for displaying.

Furthermore, a signal processing circuit was connected. The plasma display obtained allowed accurate displaying, and had a light emission efficiency of 1.1 lm/W, a white peak luminance of 200 cd/m$^2$ and a contrast of 100:1.

Without color correction for the drive circuit, the color temperature was 9000 degrees, to show that it was excellent as a display. The obtained blue luminance was measured and found to be higher than that of the plasma display of Comparative Example 1 by about 10%. In the case of full face light emission, it was confirmed that the panel display as a whole displayed a bluish white image.

EXAMPLE 2

On a 450 mm×350 mm glass board (2.8 mm thick, PD200 produced by Asahi Glass Co., Ltd.), 1920 address electrodes were formed using a photosensitive silver paste. The electrodes were formed in stripes with pitches of 260, 220 and 160 μm cyclically repeated, to have a width of 60 μm respectively. On the electrodes, a glass paste consisting of 50 wt % of a glass powder, 15% of titanium oxide, 20% of ethyl cellulose and 15% of a solvent was applied and fired at 570° C., to form a dielectric layer. On the board, black barrier ribs were formed according to said photosensitive paste method. The photo mask used was a chromium mask designed to allow a striped barrier rib pattern to be formed in a plasma display, in such a manner that the inter-rib pitch for forming the B phosphor layer might be 260 μm, that the inter-rib pitch for forming the G phosphor layer might be 240 μm, that the inter-rib pitch for forming the R phosphor layer might be 160 μm, and that the rib width might be 30 μm. A plasma display was prepared as described for Example 1, except that the above modifications were made, and a voltage was applied for displaying. The average height of the obtained barrier ribs was 133 μm, and the height differences in reference to the average height were ±3 μm.

Furthermore, a signal processing circuit was connected for displaying. A plasma display which allowed accurate displaying and had a light emission efficiency of 1.2 lm/W, a white peak luminance of 220 cd/m$^2$ and a contrast of 110:1 could be obtained.

The obtained blue luminance was measured and found to be higher than that of the plasma display of Comparative Example 1 by about 20%, and in the case of full face light emission, it was confirmed that the panel display as a whole displayed a beautiful bluish white image.

Without color correction for the drive circuit, the color temperature was 10000 degrees, to show that it was excellent as a display.

EXAMPLE 3

On a 450 mm×350 mm glass board (2.8 mm thick, PD200 produced by Asahi Glass Co., Ltd.), 2560 address electrodes were formed using a photosensitive silver paste. The electrodes were formed in stripes with pitches of 130, 130, 220 and 180 μm cyclically repeated, to have a width of 60 μm respectively. The leads of the respectively adjacent two electrodes formed at a pitch of 130 μm were connected to each other. On the electrodes, a glass paste consisting of 50 wt % of a glass powder, 15% of titanium oxide, 20% of ethyl cellulose and 15% of a solvent was applied and fired at 570° C., to form a dielectric layer. On the board, black barrier ribs were formed according to said photosensitive paste method. The chromium mask used was designed to form striped barrier ribs with pitches of 130, 130, 220 and 180 μm cyclically repeated and to have a rib width of 30 μm respectively. A plasma display was prepared as described for Example 1, except that the above modifications were made. The average height of the obtained barrier ribs was 134 μm, and the height differences in reference to the average height were ±3 μm. Then, phosphor pastes were applied to the grooves between the respectively adjacent barrier ribs by screen printing, and dried, to form phosphor layer stripes. The blue phosphor layer was formed in the respectively two adjacent grooves formed at an inter-rib pitch of 130 μm. The green phosphor layer was formed in the grooves formed at an inter-rib pitch of 220 μm, and the red phosphor layer was formed in the grooves formed at an inter-rib pitch of 180 μm. The board having electrodes, dielectric, barrier ribs and phosphor layer stripes formed was joined with a front board and hermetically sealed. The spaces between the two boards were hermetically filled with a gas, and a drive circuit was connected to prepare a plasma display.

Furthermore, a signal processing circuit was connected for displaying. A plasma display which allowed accurate displaying and had a light emission efficiency of 1.4 lm/W, a white peak luminance of 280 cd/m$^2$ and a contrast of 160:1 could be obtained.

The obtained blue luminance was measured and found to be higher than that of the plasma display of Comparative Example 1 by about 50%, and in the case of full face light emission, it was confirmed the panel display as a whole displayed a beautiful bluish white image. Without color correction for the drive circuit, the color temperature was 12000 degrees, to show that it was excellent as a display.

COMPARATIVE EXAMPLE 1

On a 450 mm×350 mm glass board (2.8 mm thick, PD200 produced by Asahi Glass Co., Ltd.), 1920 address electrodes were formed using a photosensitive silver paste. The electrodes were formed in stripes at a constant pitch of 220 μm, to have a width of 60 μm respectively. On the electrodes, a glass paste consisting of 50 wt % of a glass powder, 15% of titanium oxide, 20% of ethyl cellulose and 15% of a solvent was applied and fired at 570° C. to form a dielectric layer. On the board, black barrier ribs were formed according to said photosensitive paste method. The chromium mask used was designed to allow a striped barrier rib pattern to be formed in a plasma display, in such a manner that the pitch might be 220 μm and that the rib width might be 30 μm respectively. A plasma display was prepared as described for Example 1, except that the above modifications were made, and a voltage was applied for displaying. The average height of the obtained barrier ribs was 133 μm, and the height differences in reference to the average weight were ±10 μm. Large height differences existed locally in the lower portion of the panel. A voltage was applied to the prepared panel, for displaying. Without color correction for the drive circuit, the color temperature was 4000 degrees. Furthermore, a signal processing circuit was connected for displaying. Crosstalks occurred at the portion where rib height differences were large, not allowing accurate displaying. The plasma display obtained had a light emission efficiency of 0.9 lm/W, a white peak luminance of 180 cd/m$^2$ and a contrast of 90:1. In the case of full face light emission, it was confirmed the panel display as a whole displayed a reddish white image.

INDUSTRIAL APPLICABILITY

The plasma display of the present invention solves the problem of the conventional plasma display that the capabilities of the red and green light emitting phosphors cannot be sufficiently manifested compared to the blue light emitting phosphor, and allows that the luminance capabilities of the respective color light emitting phosphors are used almost equally, and that a well-balanced brighter color image can be displayed. It also solves the problem of the conventional plasma display that it is difficult to display a beautiful white image in the case of full face light emission, and thus allows a beautiful white image to be displayed.

What is claimed is:

1. A board for a plasma color display on which striped barrier ribs for partitioning address electrodes and discharge spaces are formed and on which phosphor layer stripes emitting red, green and blue light are respectively formed in grooves between the adjacent barrier ribs, wherein the following relation is satisfied $$Pb>Pr$$

wherein Pr is the distance between respectively adjacent barrier ribs between which the red light emitting phosphor layer stripes are formed, and Pb is the distance between respectively adjacent barrier ribs between which the blue light emitting phosphor layer stripes are formed, and wherein height differences of the barrier ribs within a board face area are within ±0.5~±6 μm with reference to the average height of the barrier ribs.

2. A board for a plasma display according to claim 1, wherein the distance Pr and the distance Pb satisfy the following relation:

$$1<Pb/Pr\leqq 4.$$

3. A board for a plasma display according to claim 1, wherein the distance Pr and the distance Pb satisfy the following relation:

$$5\ \mu m\leqq Pb-Pr\leqq 200\ \mu m$$

4. A board for a plasma display, according to claim 1, wherein the following relation is satisfied:

$$Pb>Pg$$

wherein Pg is the distance between respectively adjacent barrier ribs between which the green light emitting phosphor layer stripes are formed.

* * * * *